United States Patent [19]

Sachs

[11] Patent Number: 4,664,469

[45] **Date of Patent: * May 12, 1987**

[54] GROUNDING STRAP

[76] Inventor: Isaac Sachs, 1240 Ridgewood Drive, Chomedey, Laval, Quebec, Canada, H7W 1L3

[ * ] Notice: The portion of the term of this patent subsequent to May 27, 2003 has been disclaimed.

[21] Appl. No.: 830,984

[22] Filed: Feb. 19, 1986

Related U.S. Application Data

[63] Continuation of Ser. No. 702,429, Feb. 19, 1985, which is a continuation of Ser. No. 448,750, Dec. 10, 1982, abandoned.

[51] Int. Cl.[4] ..... H01R 13/24

[52] U.S. Cl. ..... 339/251; 339/14 R

[58] Field of Search ..... 339/14 R, 251

[56] References Cited

U.S. PATENT DOCUMENTS 1,830,947 11/1931 Klingel ..... 339/251

2,114,752 4/1938 Tallman ..... 339/251

OTHER PUBLICATIONS

Sachs Canada Ltd.; A Canadian Company for Canadian Demands, Oct. 1978, Product #PIN SC-13; 2095 Chartier Ave. Dorval, Quebec.

*Primary Examiner*—Gil Weidenfeld

*Assistant Examiner*—Paula A. Austin

*Attorney, Agent, or Firm*—Oblon, Fisher, Spivak, McClelland & Maier

[57] ABSTRACT

A one-piece pliable metal grounding strap comprises a U-shaped section having a pair of leg portions interconnected by a bight portion. One of the leg portions has an inwardly bent section extending adjacent thereof and across the bight portion, the bent section being adapted to contact on one side thereof a ground member; a hook member outwardly projects from this leg portion. A collar member is fixed to the bight portion, the collar member having a threaded bore adapted to threadably engage a screw member and being disposed to permit the screw member to frictionally engage the bent section on the other side thereof substantially perpendicularly thereto. The other leg portion is extended relative to the aforesaid one leg portion to define an elongated wrap section adapted to be bent about the ground member and over the one leg portion and the bight portion with the ground member disposed between the bent section and the wrap section. The wrap section is provided with a plurality of longitudinally spaced apart apertures adapted to receive the hook member and to register with the threaded bore for receiving the screw member.

1 Claim, 5 Drawing Figures

10
12
14
16
18
20
22
24
26
28
30
32
34
36
38

GROUNDING STRAP

This application is a continuation of U.S. patent application Ser. No. 702,429 filed Feb. 19, 1985, which was a continuation of abandoned U.S. patent application Ser. No. 448,750 filed Dec. 10, 1982.

BACKGROUND OF THE INVENTION

The present invention relates to a grounding strap and, more particularly, to a pliable metal grounding strap of the type to be bent around a ground member, such as a grounded pipe or metal post, and thereafter secured thereto.

One type of pliable metal grounding strap which has been proposed before comprises an elongated strap member having a plurality of longitudinally spaced apart holes at one end portion and a nut welded thereon at the other end portion. A flap is detachably mounted to the strap member by means of a tab and slot arrangement adjacent the nut and is adapted to be positioned intermediate the ground member and a bolt extending through the nut for securing the strap member to the ground member, prior to bending the strap member around the ground member and over the nut with one strap hole registering with the nut hole and installing the bolt. This two-piece construction is rather disadvantageous since it is difficult and time consuming to install. Further, the flap serving to provide grounding contact between the bolt and the ground member and also to protect the latter from being damaged by the bolt can be easily lost. In addition, since the nut is welded to the strap member, the weld can readily break as a result of repeated use and bending of the strap member.

In order to overcome these disadvantages, Applicant has already proposed a pliable metal grounding strap of the type described above, but in which the welded nut is replaced by a threaded collar riveted to the strap member and the detachable flap is replaced by an inwardly curved strap section integrally joined to one end of the strap member so as to provide a one-piece construction. However, as the curved strap section must first be placed on the ground member and the strap member thereafter bent over such curved section and around the ground member, the bolt or screw is often mispositioned relative to the underlying curved strap section and contacts same at an oblique angle, resulting in a poor grounding contact.

SUMMARY OF THE INVENTION

Accordingly, it is an object of this invention to overcome the aforementioned drawback and to provide a one-piece pliable metal grounding strap which avoids mispositioning of the screw and therefore ensures a good grounding.

In accordance with the present invention, there is thus provided a one-piece pliable metal grounding strap comprising an elongated wrap section adapted to be bent about a ground member, and a preformed end section contiguous to the wrap section. The preformed end section includes a planar screw mounting portion, a ground member engaging portion having one surface engageable with the ground member and another surface facing in a direction opposite the one surface, and a connecting portion interconnecting the ground member engaging portion with the screw mounting portion, the ground member engaging portion extending in opposite spaced apart relation to the screw mounting portion to define a gap therebetween. A hook member outwardly projects from the connecting portion of the preformed end section. A threaded member having a threaded bore defining a longitudinal axis is mounted in the gap and is adapted to threadably engage a screw member extending through the screw mounting portion of the preformed end section. The preformed end section has preformed bends such that the longitudinal axis of the threaded bore is oriented perpendicular to the ground member engaging portion to permit the screw member to frictionally engage the ground member engaging portion on the other surface of the ground member engaging portion substantially perpendicular thereto. The elongated wrap section is adapted to be bent about the ground member and over the connecting portion and screw mounting portion of the preformed end section with the ground member disposed between the ground member engaging portion and the wrap section, the wrap section being provided with a plurality of longitudinally spaced apart apertures adapted to receive the hook member and to register with the threaded bore for receiving the screw member.

Tightening of the screw member causes the screw member to frictionally engage with the other surface of the ground member engaging portion and causes the one surface of the ground member engaging portion to frictionally engage with the ground member and to move the screw mounting portion in a direction away from the ground member engaging portion. The hook member is thereby caused to pull the wrap section in the same direction away from the ground member to tighten the wrap section against the ground member, the preformed end section maintaining the screw member substantially perpendicular to the ground member engaging portion during tightening of the screw member. Due to the provision of a preformed end strap section having preformed bends such that the longitudinal axis of the threaded bore is oriented perpendicular to the ground member engaging portion of the strap, the screw member will always frictionally engage the ground member engaging strap portion substantially perpendicular thereto and there is no longer any possibility of the screw member being mispositioned. Thus, proper grounding is ensured whenever the grounding strap of the invention is installed.

BRIEF DESCRIPTION OF THE DRAWINGS

The invention is illustrated by way of example in the accompanying drawings, in which.

DESCRIPTION OF PREFERRED EMBODIMENTS

Figures 1, 2, 3, 4, 5:
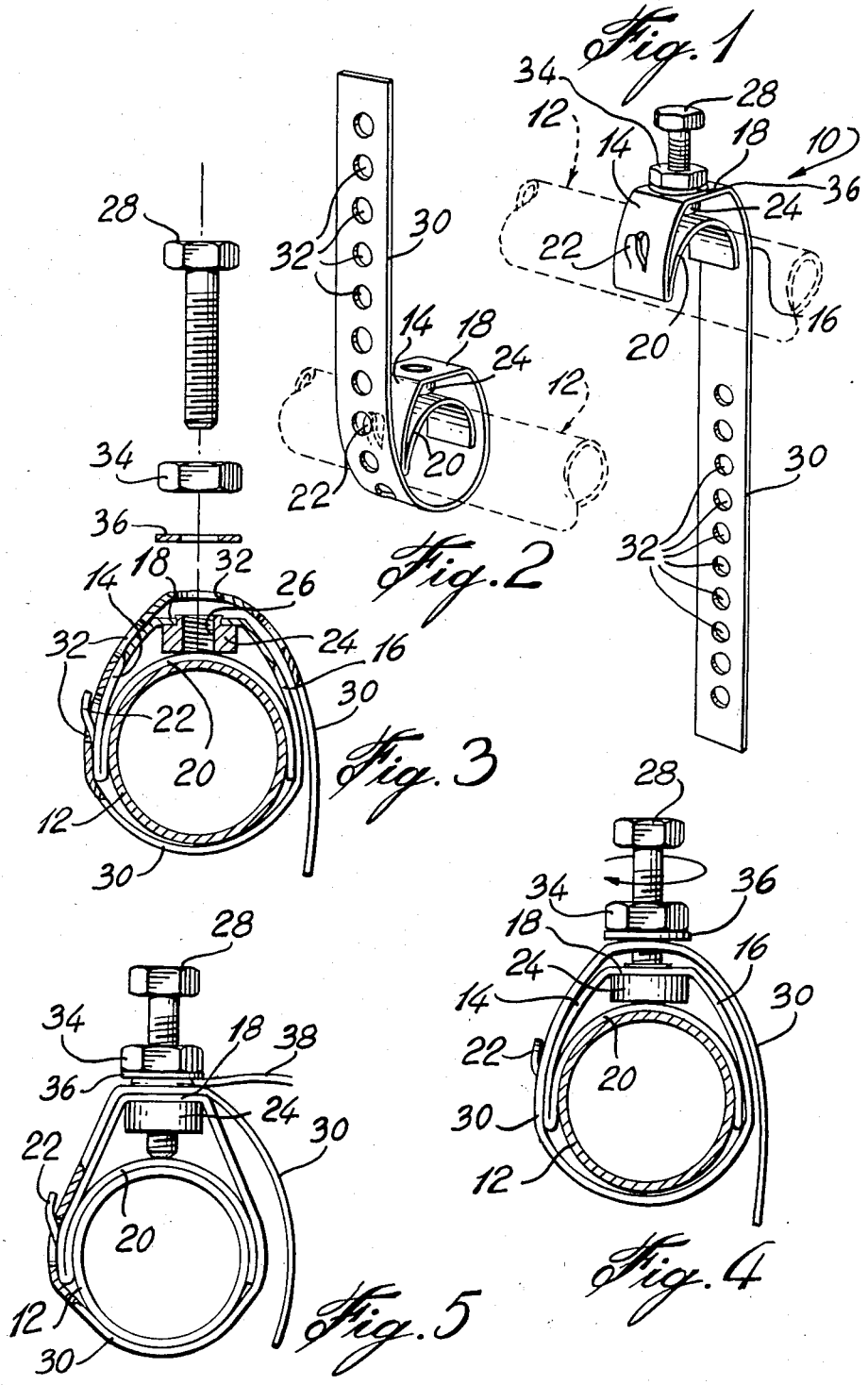
FIG. 1 is a perspective view of a grounding strap according to the invention as seen positioned on a ground member for installation thereon.
FIG. 2 is a view similar to that of FIG. 1, showing the grounding strap in a first stage of its installation.
FIG. 3 is a part sectional view showing the grouding strap in a second stage of its installation.
FIG. 4 is a part sectional side elevation view showing the grounding strap in a third stage of its installation.
FIG. 5 is another part sectional side elevation view showing the grounding strap as finally installed on the ground member.

Referring first to FIG. 1, the grounding strap illustrated and generally designated by reference numeral 10 is seen positioned for installation a ground member such as a grounded metal pipe 12 represented in broken lines. The grounding strap 10 is a one-piece copper preformed construction comprising a U-shaped section having a pair of curved leg portions 14 and 16 interconnected by a planar bight portion 18. The leg portion 14 is provided with an inwardly curved section 20 also of U-shape extending across the bight portion 18 and having one end integrally joined to leg portion 14 and the other end extending adjacent leg portion 16. As shown, the curved section is adapted to contact on its innerside the grounded pipe 12.

A hook 22 outwardly projects from leg portion 14. A collar 24 is riveted to the bight portion 18 on the side thereof facing the curved section 20. The collar 24 has threaded bore 26 adapted to threadably engage the threaded shank of screw member such as a bolt 28 and is disposed to permit the bolt 28 to frictionally engage the curved section 20 on its outerside perpendicularly thereto, as best shown in FIGS. 3 and 5.

The leg portion 16 is extended relative to leg portion 14 so as to define an elongated wrap section 30 adapted to bent about the ground member 12 and over the leg portion 14 and the bight portion 18 with the ground member 12 disposed between the curved section 20 and the wrap section 30. The wrap section 30 is provided with a plurality of longitudinally spaced apart holes 32 adapted to receive the hook 22 and also to register with the threaded bore 26 of collar 24 for receiving the bolt 28. A lock nut 34 and washer 36 complete the assembly.

In order to install the grounding strap 10 on the grounded pipe 12, the curved section 20 of the strap is first placed on the pipe 12, as shown in FIG. 1. Next, the wrap section 30 is bent around the pipe 12 and over the leg portion 14 while pressing it against the pipe in order to ensure a snug fit, as shown in FIG. 2; the strap hole 32 in closest alignment with the hook 22 is placed over the hook so as to connect the wrap section 30 to the leg portion 14. The bolt 28, lock nut 34 and washer 36 are removed and the wrap section 30 is further bent over the bight portion 18 so that another strap hole 32 registers with the threaded bore 26 of collar 24, as best shown in FIG. 3. The bolt, nut and washer assembly is reinstalled and any extra length of the wrap section 30 is bent over the leg portion 16. Thereafter, as shown in FIG. 4, the bolt 28 is tightened so as to frictionally engage with the curved section 20 against the pipe 12; as a result, the bight portion 18 is moved in a direction away from the curved section 20, which causes the hook 22 carried by the leg portion 14 to pull the wrap section 30 in the same direction and to thereby snugly tighten same against the pipe 12. The final shape of the strap thus installed is represented in FIG. 5 and it is seen that the curved section 20 and wrap section 30 of the strap snugly conform to the pipe 12 and thus provide good grounding, the shank of the bolt 28 extending perpendicularly to the curved section 20. A ground wire 38 is placed between the lock nut 34 and washer 36 and the nut is finally tightly secured.

As an example of dimensions of a suitable grounding strap 10, the overall length may be about 5 inches and the width about ½ inch. Such a grounding strap accomodates pipe diameters of ½ through 1¼ inch. As it is apparent, it provides a versatile mechanical and electrical connection for grounding to metal pipes or posts, in addition to being fast and easy to install.

I claim:

1. A one-piece pliable metal grounding strap comprising:

an elongated wrap section adapted to be bent about a ground member;

a preformed end section contiguous to said wrap section, including a planar screw mounting portion, a ground member engaging portion having one surface engageable with said ground member and another surface facing in a direction opposite said one surface, and a connecting portion interconnecting said ground member engaging portion with said screw mounting portion, said ground member engaging portion extending in opposite spaced apart relation to said screw mounting portion to define a gap therebetween;

a hook member outwardly projecting from said connecting portion of said preformed end section;

a threaded member mounted in said gap and having a threaded bore defining a longitudinal axis, said threaded member adapted to threadably engage a screw member extending through said screw mounting portion of said preformed end section; and said preformed end section having preformed bends such that the longitudinal axis of said threaded bore is oriented perpendicular to said ground member engaging portion to permit said screw member to frictionally engage said ground member engaging portion on the other surface of said ground member engaging portion substantially perpendicular thereto;

wherein said elongated wrap section is adapted to be bent about said ground member and over said connecting portion and screw mounting portion of said preformed end section with said ground member disposed between said ground member engaging portion and said wrap section, said wrap section being provided with a plurality of longitudinally spaced apart apertures adapted to receive said hook member and to register with said threaded bore for receiving said screw member, whereby tightening of said screw member causes said screw member to frictionally engage with said other surface of said ground member engaging portion and causes said one surface of said ground member engaging portion to frictionally engage with said ground member and to move said screw mounting portion in a direction away from said ground member engaging portion, thereby causing said hook member to pull said wrap section in the same direction away from said ground member to tighten said wrap section against said ground member, said preformed end section maintaining said screw member substantially perpendiccular to said ground member engaging portion during tightening of said screw member.

* * * * *